US006227884B1

(12) United States Patent
Hierzer

(10) Patent No.: US 6,227,884 B1
(45) Date of Patent: May 8, 2001

(54) CARRYING DEVICE, CONDUCTOR RAIL AND COUPLING DEVICE

(76) Inventor: Andreas Hierzer, Auer-Welsbachgasse 34, A-8055, Graz (AT)

( * ) Notice: Subject to any disclaimer, the term of this patent is extended or adjusted under 35 U.S.C. 154(b) by 0 days.

(21) Appl. No.: 09/344,154

(22) Filed: Jun. 24, 1999

(51) Int. Cl.[7] ..... H01R 25/00
(52) U.S. Cl. ..... 439/110; 439/115
(58) Field of Search ..... 439/110, 115, 439/113, 114, 210, 213

(56) References Cited

U.S. PATENT DOCUMENTS

| | | | | |
|---|---|---|---|---|
| 3,089,042 | * | 5/1963 | Hickey et al. | 307/147 |
| 3,268,848 | * | 8/1966 | Adams et al. | 339/22 |
| 4,907,137 | * | 3/1990 | Schladitz et al. | 362/145 |
| 4,919,625 | * | 4/1990 | Coutre | 439/118 |
| 5,207,589 | * | 5/1993 | Lettenmayer | 439/112 |

FOREIGN PATENT DOCUMENTS

| | | |
|---|---|---|
| 559978 | 3/1975 | (CH) . |
| 3919201 | 12/1990 | (DE) . |
| 4338705 | 5/1994 | (DE) . |

* cited by examiner

*Primary Examiner*—Paula Bradley
*Assistant Examiner*—James Harvey
(74) *Attorney, Agent, or Firm*—Ladas & Parry

(57) ABSTRACT

A carrying device for a conductor rail for supplying electrical power to lighting fixtures comprises an insulating bow-shaped retainer having resilient arms with inner latching projections for latching engagement with the conductor rail, and further having end-side latching projections, a carrying element capable of being fastened to the retainer, and a safety cover capable of being snapped onto the end-side latching projections on the resilient retainer arms; disclosed are also a conductor rail comprising two metal sections which serve as conductors and are interconnected via an insulation means; and a conductor rail coupling device.

29 Claims, 3 Drawing Sheets

Fig. 3
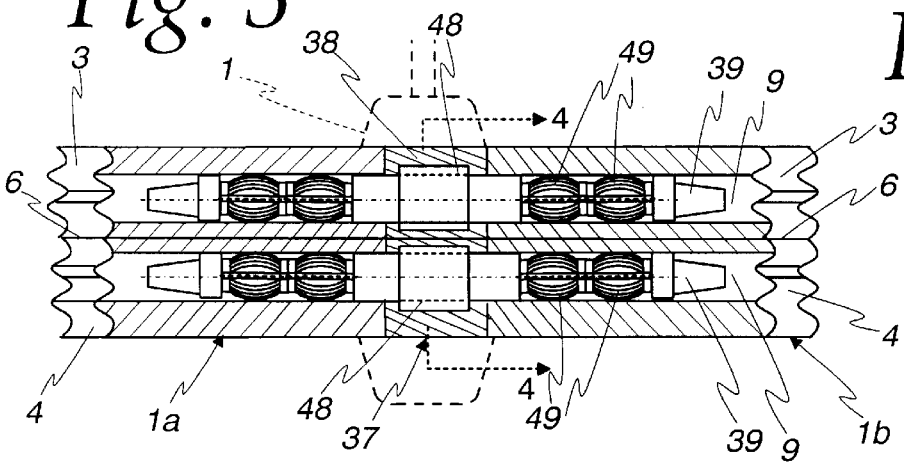
Fig. 4
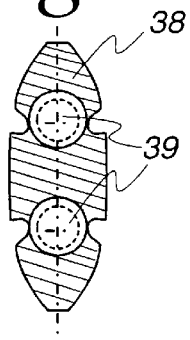
Fig. 3a
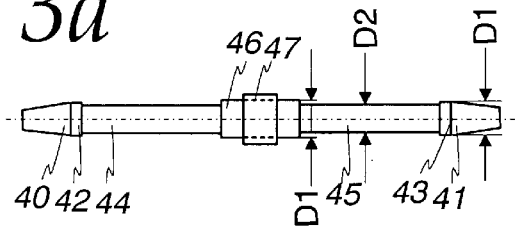
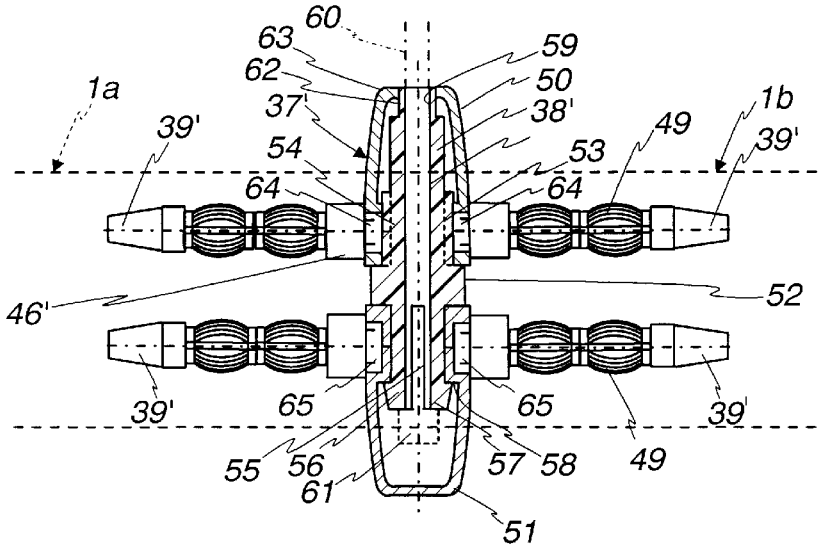
Fig. 5

CARRYING DEVICE, CONDUCTOR RAIL AND COUPLING DEVICE

FIELD OF THE INVENTION

The invention relates to a carrying device for an electrically conducting conductor rail, for supplying electrical power to lamps etc., where the conductor rail comprises metal sections and an insulation member therebetween.

Furthermore, the invention relates to a conductor rail to be used with such a carrying device, as well as to a coupling device for connecting such conductor rails.

BACKGROUND OF THE INVENTION

From CH 559 978 A, a carrying device for a conductor rail is known. For the synthetic material rail disclosed there and provided with conductors inserted in slits of this synthetic material rail, a device for attachment to a wall or to a ceiling is shown which consists of a bow which is fixed by aid of a screw. The bow is C-shaped in cross-section, and the legs of the bow at their free ends are inwardly angled to form latching projections. These angled ends engage in channels of the synthetic material rail. The bow is made of metal, and it is in electrical contact with a grounding strip. Accordingly, if the latching connection with the conductor rail is a tight one, subsequent removal of the bow from the conductor rail is relatively difficult. If the angled ends were less bent, i.e. if they were not as much designed like barbs, fixation, in turn, of the conductor rail in the bow would not be reliable.

From DE 39 19 201 A, furthermore a conductor rail consisting of two square metal sections is known, the metal sections being interconnected by means of insulators provided as plastic bolts arranged in spaced relationship in blind holes. On the plastic bolts, a carrying device not explained in detail is provided for attachment to a ceiling of a room.

SUMMARY OF THE INVENTION

It is an object of the invention to provide a carrying device for conductor rails which can quickly and easily be mounted in a stable manner and dismounted without requiring a tool, i.e. also if the conductor rail is under current, whithout the risk of short circuiting.

A further object of the invention is to provide a conductor rail for cooperation with such a carrying device, which allows for such a quick, simple attachment and detachment of the carrying device without the risk of short circuiting, and which, moreover, enables a connection in the form of a coupling device to at least one further conductor rail also in a quick and simple manner without requiring the aid of a tool.

Thus, an object of the invention is also the provision of such a coupling device for a quick, stable mechanical and electrical interconnection of conductor rails.

Accordingly, the invention, in a first aspect, provides a carrying device for a conductor rail for supplying electrical power to lighting fixtures, said carrying device comprising an insulating bow-shaped retainer having resilient arms with inner latching projections for latching engagement with said conductor rail, and further having end-side latching projections, a carrying element capable of being fastened to said retainer, and a safety cover, said cover being capable of being snapped onto said end-side latching projections on said resilient arms of said retainer. On account of this design, the carrying device can be mounted and secured in a simple manner, quickly and stable by means of the snap connection between the retainer and the metal section, so that an undesired detachment will reliably be avoided; nevertheless, the retainer can be taken off the conductor rail without any problems, likewise without requiring any tools. Mounting and dismounting, respectively, of the carrying device is also possible if the conductor rail is under current, i.e. live, since the possibility of a short circuit is excluded by the insulating configuration of the retainer, in particular by being made as a shaped body of insulating material.

A suitable, structurally simple snap connection between the retainer and the metal section can be attained if an undercut portion is provided in the cover for the outside latching projections at the ends of the resilient arms to snap thereinto.

To ensure the snap connection, it is also advantageous if the contour of the cavity of the retainer in the region of the upper part of the conductor rail is adapted to the convex exterior thereof. In this manner, also the other metal section can be fixed in its position in a stable manner.

To stabilize the retainer legs, it is also suitable if the resilient arms project from a collar of the retainer onwards.

To enable an economical production of the retainer, on the one hand, preferably as a shaped body by injection moulding, and to provide for a simple way of fastening the carrying device to a ceiling, on the other hand, it is furthermore advantageous if the retainer is generally rotationally symmetrically designed and tapers in the direction of its rotational axis towards its one end, the retainer having a cylindrical projection with a central bore for passing the carrying element therethrough at the end of that tapered portion.

In this case, it is furthermore advantageous if the end of the cylindrical projection has an, e.g. outwardly conical, thickened portion, onto which the rim of a central bore of a cover cap can be snapped which surrounds the tapered portion of the retainer. In combination with the cap-shaped safety cover in the region of the arms of the retainer, an optically pleasing, symmetrical design of the carrying device can be attained in this manner.

For determining the individual components of the carrying device relative to each other, it is furthermore advantageous if the collar forms an abutment for the safety cover and the cover cap.

To attain a compact, stable arrangement of carrying device and conductor rail which gives an optically pleasing general impression, it is furthermore suitable if for a tight accommodation of the conductor rail, the safety cover and/or the cover cap is/are adapted with mutually aligned cavities adapted to the convex contour of the conductor rail.

To release the snap connection between the cover and the retainer in the region of the resilient arms of the retainer, it is advantageous for the cover to be provided with bores in the region of the outer latching projections of the resilient arms of the retainer, whereby the latching projections can be bent back by introducing pins of an auxiliary tool into these holes to thus release the snap connection.

According to a second aspect of the invention, a conductor rail to be used with a carrying device according to the invention is provided which comprises two metal sections as conductors which are interconnected via an insulation; at least one of the metal sections at its outer longitudinal sides is provided with longitudinal grooves for latching engagement with the retainer. The longitudinal grooves provide for the desired simple coupling with the retainer of the carrying device of the invention and with the safety cover by latching engagement. Preferably, the two metal sections are provided with longitudinal grooves so that the retainer can be latched with each one of the two metal sections. In this respect, a symmetrical design of the conductor rail is advantageous, and to this end, it is further suitable if the cross-section of the metal sections forming the conductor rail are each generally semi-oval, and the metal sections are interconnected at their facing base portions via an insulating strip acting as an insulation.

To supply current from a current supply source as well as to electrically and mechanically couple two or more conductor rails, it is furthermore suitable if each one of the metal sections comprises a slit departing from its base portion, which slit enters into a bore in which contact pins can be plucked in for the transmission of current.

Furthermore, it is advantageous if the metal sections are flattened at their narrow sides, i.e. longitudinal rims, facing away from each other. By this plane design, the conductor rail has a mechancially stable construction which is favorable for contacting purposes.

Since the present conductor rails are produced in certain lengths or are cut to certain lengths, respectively, in most cases a serial arrangement of several conductor rails will be required to obtain the desired total length of the conductor rail. For this purpose, the invention according to its third aspect further provides an adapted coupling device in which a coupling part having an insulating part separating the conductor rails is provided to transmit current between at least two conductor rails, the insulating part carrying the contact pins. In this manner, a defined current path from the conductor rails to the contact pins is established, and an undesired direct current transmission between the conductor rails is avoided.

Here it is particularly also provided that the cross-section of the insulating part of the coupling part is adapted to the cross-section of the conductor rails and that two contact pins can be screwed with a thread in threaded bores of the insulating part, the contact pins projecting on both sides of the insulating part and capable of being plugged into the bores of the metal sections. By this design of the insulating part, an optically nearly inconspicuous shape of the connection site of two conductor rails is attained.

Alternatively, however, the coupling part may also consist of a generally cylindrical insulating part having an axial bore, and two metal caps carrying the contact pins, which metal caps are fastened to the insulating part and are kept apart from each other by a shoulder of the insulating part. Also in this embodiment, the current path is exactly defined, i.e. likewise from the conductor rail to the contact pins and from the latter to the respective metal cap which serves as current transmission structural element, wherein at the same time purposefully, an optically pleasing shape of the connecting site of two conductor rails can be provided by appropriately designing the metal caps.

To releasably fasten the one metal cap on the insulating part, it is advantageous if this one metal cap at its rim side is provided with an inner thread by means of which it can be screwed onto an outer thread of the insulating part, which outer thread follows upon the shoulder of the insulating part.

To fasten the other metal cap it is advantageous if the other metal cap has an undercut portion in which hook-shaped ends of two arms can be snapped in, which are formed by a slit departing from the shoulder of the insulating part.

To fasten the contact pins on the metal caps, it has proven advantageous if the metal caps are generally conically shaped and comprise two opposite threaded bores in the region above and below the shoulder of the insulating part, in which one threaded end of the contact pins can be screwed in. If the arms are designed to be resilient, they can be pressed together by aid of a tool inserted through the threaded bores of the other metal cap and having pin-like legs so as to release the snap connection, so that also the other metal cap is detachable from the insulating part.

In a further embodiment it is provided that the one metal cap has a bottom-side bore for passing an offset end section of the insulating part therethrough, while the other metal cap is closed on its bottom side, a carrying rod being mountable in the axial bore of the insulating part so that an additional attachment means is provided in a simple manner at the connection site of the conductor rails.

A particularly suitable embodiment furthermore consists in that the outer side of the cover caps in the transition region to the conductor rails passes over from the conical shape into a square shape, wherein selectively additional conductor rails crossing the first-mentioned conductor rails can be attached to the coupling part. By this, a combination of e.g. one conductor rail extending in one direction and a conductor rail arranged at a right angle thereto, or of one conductor rail with two crossing conductor rails etc. can be effected in an advantageous manner, too.

To define a defined current transition with good conductivity between the contact pins and the wall of the bores of the metal sections, it is of particular advantage if the contact pins carry at least one contact collar which conductively connects the wall of the bore of the metal sections with the contact pins.

In a preferred further development, it is advantageously provided that the contact collar consists of a plurality of crowned and circularly arranged resilient metal lamellae which at their end side each merge into a circular ring member which is slit, whereby the contact collar can be snapped onto the contact pin. By this it is ensured that the current conduction is effected in a defined manner from the contact pin to the ring members of the contact collar, on the one hand, and from the lamellae of the contact collar to the wall of the bore of the metal section, on the other hand. By designing the lamellae to be resilient, also "intermittent contacts" can be avoided.

Here it is furthermore advantageous if two contact collars are provided for each contact pin. By this, the current load carrying capacity and the contact safety of the coupling devices is substantially increased.

It may be mentioned that from DE 4 338 705 A a coupling device for at least two conductor rails is known wherein a cross-wise rail connection is enabled. There, the contact pins are arranged in the horizontal plane, the connection of the contact pins being made via two contact disks, and the contact pins being arranged in a two-part, annular housing of insulating material. To safely avoid a short-circuit between the contact pins in the region of the contact disks, the contact pins have flattened and skew portions.

DESCRIPTION OF THE DRAWINGS

The invention will now be explained in more detail by way of a preferred exemplary embodiment illustrated in the drawings to which, however, it shall not be restricted.

FIG. 3 shows a longitudinal section of a coupling device for the conductor rails according to FIGS. 1 and 2;

FIG. 3*a* shows a view of a part of a coupling pin of the coupling device according to FIG. 3;

FIG. 4 shows the coupling device according to FIG. 3 in a section along line IV—IV of FIG. 3;

FIG. 5 shows a longitudinal section of a different coupling device for the present conductor rails;

DETAILED DESCRIPTION

Figure 1:
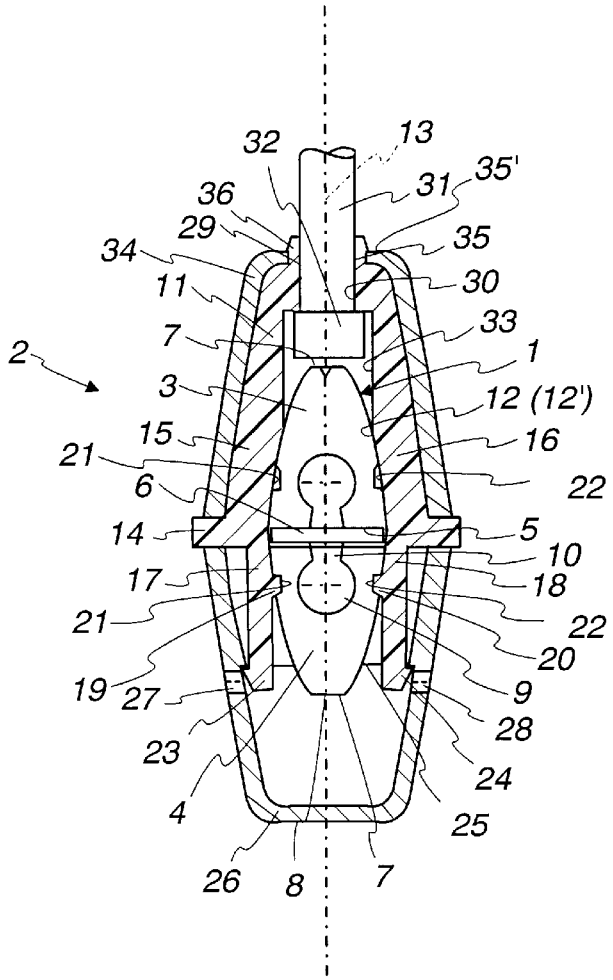
FIG. 1 shows a carrying device for a conductor rail as well as the conductor rail in a schematical sectional view.
Figure 2:
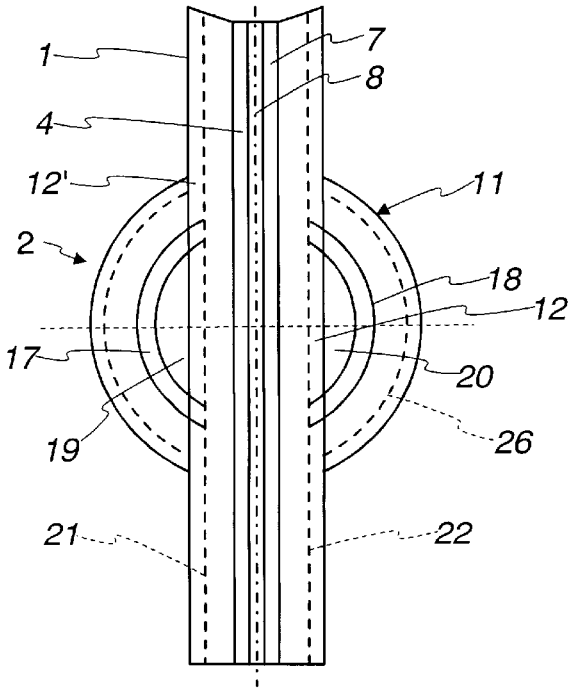
FIG. 2 shows the carrying device according to FIG. 1, together with the conductor rail, in a bottom view, yet with the lower safety cover removed.

In FIGS. 1 and 2, a conductor rail 1 and a carrying device generally denoted by 2 for this conductor rail 1 are shown for supplying electrical power to lighting fixtures, in particular low voltage lighting fixtures. Viewed in cross-section, the conductor rail 1 has a generally oval contour and is made up of two metal sections 3, 4, preferably of aluminum or an aluminum alloy, respectively, each having a generally semi-oval cross-sectional shape; these metal sections 3, 4 are interconnected at their plane base portions 5, e.g. by gluing, via a strip-shaped insulation 6 of synthetic material. At their narrow sides 7 located opposite the base portion 5, the metal sections 3, 4 are flattened and there they are each provided with a central groove 8 for contacting purposes (when lighting fixtures are connected thereto). Furthermore, each metal section 3, 4 has a central bore 9 communicating with a slit 10 directed towards the base 5. The bores 9 serve for supplying current, on the one hand, via contact pins (not illustrated in FIGS. 1 and 2). from a supply source, and, on the other hand, for electrically and mechanically interconnecting or coupling, respectively, two or more conductor rails via contact pins, as will be explained in more detail further below, by way of FIGS. 3 to 6.

The carrying device 2 comprises a generally rotationally symmetrical shaped body in the form of a bow-shaped retainer 11 of insulating material, e.g. synthetic material, which has a cavity 12 to receive the conductor rail 1. There, the upper half of the contour of the cavity 12 matches the outer contour of the upper metal section 3, whereas the lower half of the contour of the cavity 12 extends in parallel to the longitudinal axis 13 of the retainer 11. The width of the cavity 12 corresponds to the width of the base portion 5 of the metal sections 3, 4. In the region of the insulating strip 6 of the conductor rail 1, the retainer 11 is outwardly widened to form a collar 14. Due to the cavity 12, bow legs 15, 16 are formed which continue from the collar 14 into resilient arms 17, 18.

In the region of the bores 9, the metal sections 3, 4 of the conductor rail 1 have longitudinal grooves 21, 22 on their outer contour, into which inner, e.g. hook-shaped, latching projections 19, 20 formed on the resilient arms 17, 18 of the retainer 11 can be snapped in. Moreover, the ends of the resilient arms 17, 18. have hook-shaped outside latching projections 23, 24 capable of being snapped into an undercut portion 25 provided on the inner wall of a cap-shaped lower, metal safety cover 26. This lower cover 26 has been omitted in FIG. 2 for the purpose of a better illustration. The lower cover 26 abuts the collar 14, tapers generally conically downwardly and is flatly rounded at its bottom side. At the level of the outer latching projections 23, 24 of the arms 17, 18, bores 27, 28 are provided in the lower cover 26 which serve for inserting an auxiliary tool, e.g. tongs having angled, pin-shaped ends, to bend the latching projections 23, 24, or the arms 17, 18, respectively, towards the conductor rail 1 to release the snap connection between the cover 26 and the hook-shaped latching projections 23, 24 when it is wished to remove the carrying device 2. In this manner, the lower cover cap 26 is downwardly removable, and by lateral straddling of the arms 17, 18 and thus of the inner hook-shaped latching projections 19, 20, the retainer 11 can be upwardly drawn off the conductor rail 1 to remove the former from the conductor rail. In this way, an extremely simple mounting and dismounting, respectively, of the carrying device 2 is enabled by latching and releasing the latching connection, respectively.

Starting from the collar 14, the outer contour of the retainer 11 tapers generally conically, preferably in the form of a paraboloid, upwardly. The upper end of the retainer 11 has a short cylindrical projection 29 with a central bore 30 which serves for receiving a carrying element, here in the form of a carrying rod 31 with a widened head 32, as a suspension means for fastening e.g. to a ceiling, the bore 30 passing over into a bore 33 of larger diameter, and the widened head 32 resting on the shoulder formed by the transition of the bores 30, 33. Instead of a carrying rod, it is, of course, also possible to use a carrying tube, a carrying rope or a carrying chain.

An upper cover cap 34 which may consist of metal is adapted to the outer contour of the retainer 11 and follows flush on the collar 14; this cover cap 34 is provided with a central bore 35 for the projection 29 of the shaped body 11 to pass therethrough. The end of the projection 29 is formed as a conically thickened portion 36 so as to form a releasable annular latching connection together with the rim of the bore 35 of the cover cap 34 for fixing the cover cap 34 on the retainer 11.

Both the cover 26 and the cover cap 34 are provided with cavities 12' in the region of the conductor rail 1 (cf. FIG. 2), the contour of the cavities 12' matching the outer contour of the metal sections 3, 4 or coinciding with the contour of the cavity 12 of the retainer 11, respectively.

Mounting of the conductor rail 1 on the carrying device 2 is effected such that the conductor rail 1 is slid in from below into the retainer 11 or its cavity 12, which retainer 11 has already been provided with the carrying rod 31 mounted on a ceiling and the upper cover cap 34, until the hook-shaped latching projections 19, 20 of the arms 17, 18 snap into the longitudinal grooves 21, 22 of the lower metal section 4, whereupon the lower cover 26 is put on and urged against the conductor rail 1 until the hook-shaped latching projections 23, 24 snap into the undercut portion 25 of the lower cover 26.

FIGS. 3 and 4 show a coupling part 37 for two conductor rails 1*a*, 1*b* which are in linear alignment. The structure of the conductor rails 1*a*, 1*b* is identical with that of conductor rail 1 described by way of FIGS. 1 and 2 so that such description need not be repeated. The coupling part 37 is comprised of an insulating part 38 whose outer contour is identical with that of the conductor rails 1*a*, 1*b*, as is apparent from FIG. 4, and it carries two identical contact pins 39 which are in alignment with the bores 9 of the metal sections 3, 4 of the conductor rails 1*a*, 1*b* and will be inserted in these bores 9.

The contact pin 39 separately illustrated in FIG. 3*a* is frustoconical at its end portions 40, 41, thus facilitating insertion of the contact pin 39 into the bores 9 of the metal sections 3, 4. The frustoconical end portions 40, 41 change over into a short, cylindrical portion 42, 43 of a diameter D1 followed by a cylindrical portion 44, 45 of reduced diameter D2, to then merge into a central portion 46 of the same diameter D1 as the short cylindrical portion 42, 43, and partially provided with a thread 47 serving for screwing the contact pin 39 into one of two threaded bores 42 in the insulating piece 48.

Each contact pin 39 carries two contact collars 49 on either end of the insulating part 38 (omitted in FIG. 3*a*), which are arranged one after the other on the cylindrical portion 44, 45 having the reduced diameter D2 (cf. FIG. 3). The structure and the attachment of the contact collars 49 on the respective contact pin 39 will be explained further below.

As is illustrated in dot-and-dash lines in FIG. 3, a carrying device 1 as described with respect to FIGS. 1 and 2 may also be arranged on the site of abutment of the two conductor rails 1*a*, 1*b*, i.e. over the insulating part 38 to optionally cover the insulating part 38 for optical reasons.

Figure 6:
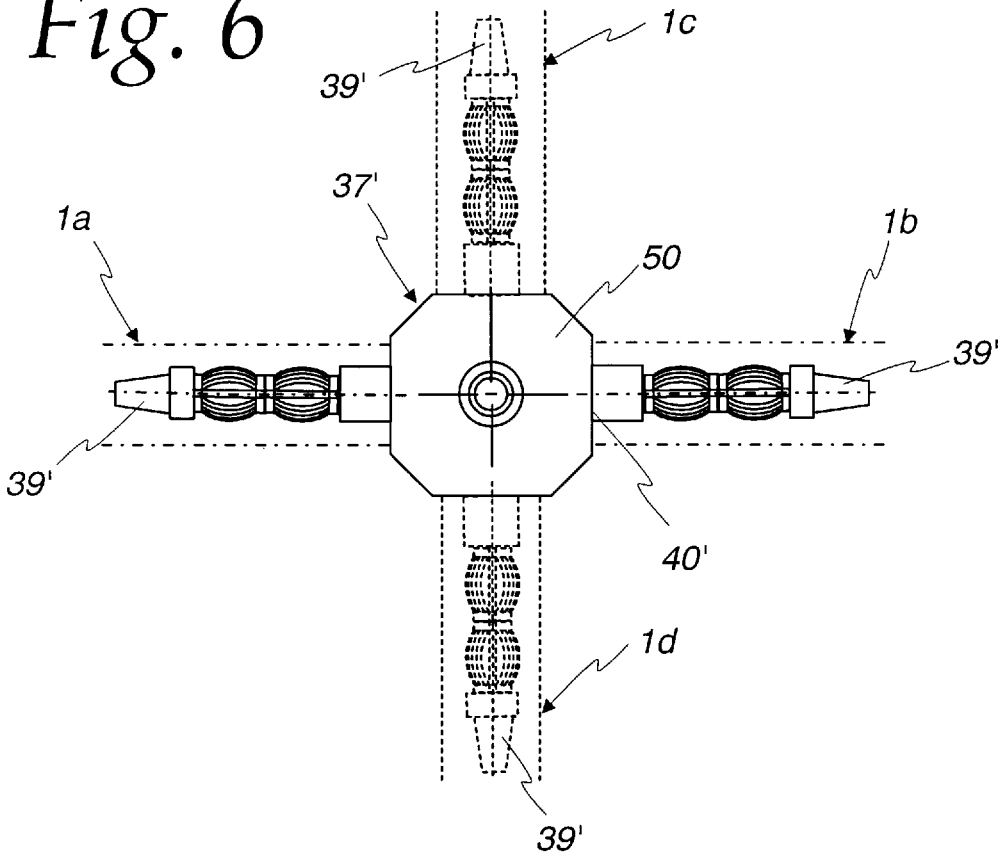
FIG. 6 shows a top view of the coupling device according to FIG. 5.

FIGS. 5 and 6 show a modified coupling part 37' for connecting two conductor rails 1*a*, 1*b* illustrated in dot-and-dash lines. The coupling part 37' is comprised of a generally cylindrical insulating part 38' and two conical metal caps 50, 51 fastened to the insulating part 38' and separated and insulated from each other, respectively, by a shoulder 52 of the insulating part 38'. The upper metal cap 50 has an internal thread 53 at its rim, by means of which this metal cap 50 is screwed onto an externally threaded portion 54 of the insulating part 38', following upon the shoulder 52. The lower metal cap 51 is connected with the insulating part 38' by means of an annular snap connection. For this purpose, the insulating part 38' has a slit 55 departing from the shoulder 52 and extending as far as to the front side of the insulating part 38', thus forming two resilient arms 56, 57 which have hook-shaped ends and can be snapped in at an undercut portion 58 of the lower metal cap 51.

The insulating part 38' has an axial bore 59 provided for receiving a carrying rod 60 or the like illustrated in dot-and-dash lines, having a widened head 61 at its end side. The upper metal cap 50 has a bottom-side bore 63 for the carrying rod 60 or an offset portion 62 of the insulating part 38', respectively, to be guided therethrough, while the lower metal cap 51 is closed at its bottom side.

Both metal caps 50, 51 have oppositely arranged threaded bores 64 in the region of their connection with the insulating part 38', into which contact pins 39' are screwed, which carry a thread 65 on one end, and which are followed by the portions having different diameters D1, D2 and with the contact collars 43 already described by way of FIG. 3*a*. In this case, the portion 46' provided with the thread 65 ends flush with the outer contour—designed to be flat in this region—of the metal caps 50, 51 which in this region, or in the region of transition to the conductor rails 1*a*, 1*b* change from cone shape to a square shape, as is apparent from FIGS. 5 and 6.

In this manner, also further conductor rails 1*c*, 1*d*, illustrated in broken lines in FIG. 6, and which are arranged with respect to the conductor rails 1*a*, 1*b* at right angles, can be interconnected or connected with the conductor rails 1*a*, 1*b* by means of the coupling part 37'. Yet, also a combination of merely one conductor rail 1*a* or 1*b* with merely one crossing conductor rail 1*c* or 1*d*, or one conductor rail 1*a* or 1*b* with two conductor rails 1*c*, 1*d*, may be provided.

Figure 7:
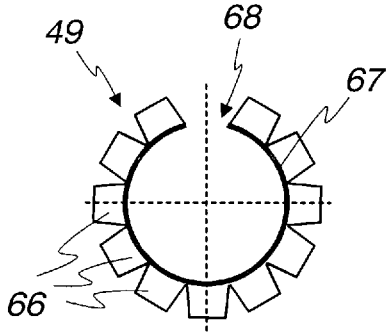
FIG. 7 is an enlarged representation of a contact collar of the coupling devices according to FIGS. 3 to 6, in front view.
Figure 8:
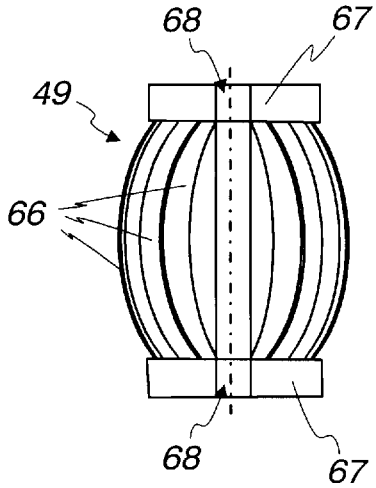
FIG. 8 is a top view onto the contact collar according to FIG. 7.

The contact collar 49 illustrated in FIGS. 7 and 8 consists of a resilient metal material, e.g. spring steel or spring bronze, which is covered by a thin layer of contact material, and it has several, e.g. eleven, circularly arranged and crowned lamellae 66 which each merge into a circular ring member 67 at their end side, the ring members being interrupted by a central slit 68 having approximately the width of one lamella 66 so that the contact collar 49 can be slipped over the conical end portion 40 or 41, respectively, onto the contact pin 39 or 39', respectively, the slit 68 widening accordingly until the entire contact collar 49 snaps onto the contact pin 39, 39' in the portion 44 or 45, respectively, of the reduced diameter D2; at this, the slit 68 narrows again. When inserting the contact pins 39, 39' provided in this manner with contact collars 49, into the bores 9 of the metal sections 3, 4 of the conductor rails 1 or 1*a* to 1*d*, respectively, the lamellae 66 are pressed against the wall of the bores 9 and thus are compressed in radial direction to the contact pins 39, 39' so that the slit 68 narrows and the ring members 67 thereby simultaneously are pushed apart in axial direction until the two contact collars 49 extend precisely over the entire length of the portion 44 or 45, respectively, of the contact pins 39, 39'. This provides for a good electrically conductive connection from the contact pins 39, 39' themselves to the ring members 67, on the one hand, and from the lamellae 66 to the wall of the bore 9, on the other hand.

What is claimed is:

1. A carrying device for a conductor rail for supplying electrical power to lighting fixtures, said carrying device comprising an insulating bow-shaped retainer having resilient arms with inner latching projections for latching engagement with said conductor rail, and further having end-side latching projections, a carrying element capable of being fastened to said retainer, and a safety cover, said cover being capable of being snapped onto said end-side latching projections on said resilient arms of said retainer.

2. A carrying device as set forth in claim 1, wherein an undercut portion is provided in said cover, said end-side latching projections on said resilient arms of said retainer being capable of snapping into said undercut portion.

3. A carrying device for a conductor rail according to claim 1, said conductor rail having an upper part, a lower part and a convex outer side, the carrying device retainer further comprising a cavity with a partly concave contour adapted to match the convex outer side of the upper part of the conductor rail.

4. A carrying device as set forth in claim 1, wherein said retainer includes an annular collar, said resilient arms of said retainer extending away from said annular collar.

5. A carrying device as set forth in claim 1, wherein said retainer is generally rotationally symmetrically shaped tapering towards one end thereof thus forming a tapered portion, said retainer having a cylindrical projection with a central bore therein at said tapered portion, said carrying element passing through said central bore.

6. A carrying device as set forth in claim 5, further comprising a cover cap surrounding said tapered portion of said retainer and having a central bore with a rim, the end of said cylindrical projection of said retainer having a thickened portion onto which the rim of said central bore of said cover cap can be snapped.

7. A carrying device as set forth in claim 6, wherein said thickened portion is outwardly conical.

8. A carrying device as set forth in claim 4, wherein said annular collar forms an abutment for said cover.

9. A carrying device as set forth in claim 4, wherein said retainer is generally rotationally symmetrically shaped tapering towards one end thereof thus forming a tapered portion, said retainer having a cylindrical projection with a central bore therein at said tapered portion, said carrying element passing through said central bore, further comprising a cover cap surrounding said tapered portion of said retainer and having a central bore with a rim, the end of said cylindrical projection of said retainer having a thickened portion onto which the rim of said central bore of said cover cap can be snapped, said annular collar of said retainer forming an abutment for said first cover and said cover cap.

10. A carrying device as set forth in claim 9, wherein said cover cap is provided with aligned openings having a contour adapted to the convex contour of said retainer and conductor rail to tightly receive said retainer and conductor rail.

11. A carrying device as set forth in claim 8, wherein said cover is provided with aligned openings having a contour adapted to the convex contour of said retainer and conductor rail to tightly receive said retainer and conductor rail.

12. A carrying device as set forth in claim 2 wherein said cover has bores near said end-side latching projections of said resilient arms of said retainer.

13. A combination carrving device and conductor rail to be used with said carrying device for supplying current to lighting fixtures, said carrying device comprising:

an insulating bow-shaped retainer having resilient arms with inner latching projections for latching engagement with said conductor rail, and further having end-side latching projections;

a carrying element capable of being fastened to said retainer; and a safety cover, said cover being capable of being snapped onto said end-side latching projections on said resilient arms of said retainer; and wherein said conductor rail includes two metal sections provided as conductors, and an insulation between said two metal sections for mechanically interconnecting them, at least one of said two metal sections including longitudinal grooves provided at outer longitudinal sides for snapping engagement of said inner latching projetions of said retainer in said longitudinal grooves.

14. A combination carrying device and conductor rail as set forth in claim 13, wherein each one of said two metal sections forming said conductor rail is generally semi-oval in cross-section and said two metal sections have base portions facing each other, said insulation being configured as an insulating strip interconnecting said two metal sections at their facing base portions.

15. A combination carrying device and conductor rail as set forth in claim 14, wherein each one of said two metal sections has a slit starting from the respective base portion and entering into a bore into which contact pins can be plugged in to conduct current from one conductor rail to an adjacent one.

16. A combination carrying device and conductor rail as set forth in claim 14, wherein said two metal sections have narrow sides facing away from each other, said narrow sides of said metal sections being flattened.

17. A coupling arrangement comprising a plurality of adjacent conductor rails as set forth in claim 15, and a coupling part for conducting current between said plurality of adjacent conductor rails, said coupling part including an insulating part separating said conductor rails, and contact pins being carried by said insulating part.

18. A coupling arrangement as set forth in claim 17, wherein said insulating part of said coupling part has a cross-section adapted to the cross-section of said conductor rails and wherein said insulating part includes threaded bores, the contact pins being provided with a thread and being capable of being screwed into said threaded bores of said insulating part, said contact pins projecting on both sides of said insulating part for insertion in said bores of said metal sections.

19. A coupling arrangement as set forth in claim 17, wherein said coupling part comprises a generally cylindrical insulating part including a shoulder and two metal caps carrying said contact pins, said metal caps being fastened to said insulating part and separated from each other by said shoulder of said insulating part.

20. A coupling arrangement as set forth in claim 19, wherein said cylindrical insulating part has an axial bore.

21. A coupling arrangement as set forth in claim 19, wherein one of said two metal caps includes an inner thread, an outer thread being provided on said insulating part following said shoulder, said inner thread of said one metal cap being capable of being screwed onto said outer thread of said insulating part.

22. A coupling arrangement as set forth in claim 21, wherein said other one of said two metal caps includes an undercut portion, and wherein said insulating part has a slit starting at the shoulder of said insulating part thus forming two arms having hook-shaped ends, said hook-shaped ends of said two arms of said insulating part being capable of being snapped into said undercut portion of said other one of said two metal caps.

23. A coupling arrangement as set forth in claim 19, wherein said two metal caps are generally conical and each have two oppositely arranged threaded bores in areas above and below said shoulder of said insulating part, said contact pins each having a threaded end capable of being screwed into said threaded bores of said metal caps.

24. A coupling arrangement as set forth in claim 19, wherein one of said two metal caps has a bore and said insulating part has a stepped end portion to be guided through said bore of said one metal cap, the other one of said two metal caps being closed at its bottom side, and wherein a carrying rod is capable of being mounted in said axial bore of said insulating part.

25. A coupling arrangement as set forth in claim 19, wherein said two metal caps have a generally conical outer side which changes from conical to square in a transition region to the conductor rails.

26. A coupling arrangement as set forth in claim 25, wherein additional conductor rails extending transversely to said conductor rails are attached to said coupling part.

27. A coupling arrangement as set forth in claim 17, wherein said contact pins carry at least one contact collar for providing electrical contact to the respective metal section within a bore thereof.

28. A coupling arrangement as set forth in claim 27, wherein said at least one contact collar includes several crowned and circularly arranged resilient metal lamellae merging into a circular ring member at their end sides, a slit interrupting said circular ring member so as to render said contact collar capable of being snapped onto a respective one of said contact pins.

29. A coupling arrangement as set forth in claim 27, wherein two contact collars are provided for each respective contact pin.

* * * * *